US006270280B1

(12) United States Patent
Baumann

(10) Patent No.: US 6,270,280 B1
(45) **Date of Patent: *Aug. 7, 2001**

(54) SPINE BINDER

(75) Inventor: Manfred Baumann, Diepoldsau (CH)

(73) Assignee: Ibico Trading GmbH (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/313,046

(22) Filed: May 17, 1999

Related U.S. Application Data

(63) Continuation of application No. PCT/CH98/00392, filed on Sep. 14, 1998.

(30) Foreign Application Priority Data

Sep. 17, 1997 (CH) ..... 2194/97

(51) Int. Cl.[7] ..... B42F 13/20

(52) U.S. Cl. ..... 402/39; 402/20; 402/38; 402/60

(58) Field of Search ..... 402/38, 39, 40, 402/45, 58, 60, 61, 63, 68, 20

(56) References Cited

U.S. PATENT DOCUMENTS

| | | | |
|---|---|---|---|
| 754,791 | | 3/1904 | Mentzer . |
| 1,119,786 | * | 12/1914 | Morden . |
| 1,343,103 | | 6/1920 | Wolf . |
| 1,537,675 | | 5/1925 | Horn . |
| 1,816,021 | * | 7/1931 | Meyerson . |
| 1,970,285 | | 8/1934 | Douvry . |
| 2,099,881 | * | 11/1937 | Emmer ..... 402/20 |
| 2,139,480 | | 12/1938 | Young . |
| 2,242,185 | | 5/1941 | Spinner . |
| 2,311,090 | * | 2/1943 | Schade . |
| 2,314,204 | | 3/1943 | Fontecilla . |
| 2,322,180 | * | 6/1943 | Vernon . |
| 2,363,848 | * | 11/1944 | Emmer ..... 402/20 |
| 2,374,803 | | 5/1945 | Broadwell . |
| 2,435,848 | * | 2/1948 | Schade . |

(List continued on next page.)

FOREIGN PATENT DOCUMENTS

| | | |
|---|---|---|
| 704322 | 4/1996 | (EP) . |
| 1364099 | 9/1964 | (FR) . |
| 229515 | 2/1925 | (GB) . |
| 755953 | 8/1956 | (GB) . |

OTHER PUBLICATIONS

*Database WPI,* Week 9747, Derwent Publications Ltd., London, GB; Class P76, B42F 013/22, WPI Acc No. 97–507927/199747, Abstract of JP 9240184 A (1997).

*Primary Examiner*—A. L. Wellington
*Assistant Examiner*—Monica S. Carter
(74) *Attorney, Agent, or Firm*—Leydig, Voit & Mayer, Ltd.

(57) ABSTRACT

The invention relates to a unitary spine binder for securing a stack of sheets, which comprises a dorsal part (3, 4, 5) from which spaced fingers (1, 11) extend to form loops. The individual fingers are arranged in two sections (1, 11) lying opposite one another on this dorsal part (3, 4), the dorsal part (3, 4, 5) forming a hinge between the finger sections (1, 11). The end (12) of at least one of the first finger elements (1) remote from its dorsal part is equipped with a push button (7); the end (22) of the second finger element (11) remote from its dorsal part and lying opposite the first finger element is equipped with an opening (10) essentially complementary to the push button (7), and which is adapted to receive the push button (7). In this way, a simple spine binder is created which does not require the use of additional binding devices. Sheets can be removed from the spine binder or newly inserted into it.

19 Claims, 3 Drawing Sheets

U.S. PATENT DOCUMENTS

| | | | | |
|---|---|---|---|---|
| 2,459,541 | | 1/1949 | Russell . | |
| 2,489,706 | | 11/1949 | Emmer . | |
| 2,582,953 | | 1/1952 | Bender . | |
| 2,629,382 | | 2/1953 | Gomez . | |
| 2,664,897 | * | 1/1954 | Derringer . | |
| 3,180,488 | | 4/1965 | Heusmann . | |
| 3,191,319 | | 6/1965 | Waisgerber . | |
| 3,205,897 | * | 9/1965 | Jamison | 402/20 |
| 3,270,749 | * | 9/1966 | O'Connell | 402/501 |
| 3,276,450 | | 10/1966 | Pelezzare . | |
| 4,429,901 | | 2/1984 | Clery, Jr. et al. . | |
| 4,511,274 | | 4/1985 | Chen . | |
| 4,577,985 | | 3/1986 | Beyer . | |
| 4,607,970 | * | 8/1986 | Heusinkveld | 402/20 |
| 4,832,207 | | 5/1989 | Alexander . | |
| 4,904,103 | * | 2/1990 | Im | 402/38 |
| 5,009,537 | | 4/1991 | Stengel . | |
| 5,015,114 | * | 5/1991 | Miller | 402/4 |
| 5,028,159 | * | 7/1991 | Amrich et al. | 402/20 |
| 5,039,229 | | 8/1991 | Stengel . | |
| 5,138,855 | | 8/1992 | Faris . | |
| 5,167,463 | | 12/1992 | Corbishley . | |
| 5,393,156 | * | 2/1995 | Mullin et al. | 402/38 |
| 5,524,997 | | 6/1996 | von Rohrscheidt . | |
| 5,782,569 | * | 7/1998 | Mullin et al. | 402/36 |

* cited by examiner

X
X

SPINE BINDER

This application is a continuation of PCT/CH98/60392 Sep. 14, 1998.

TECHNICAL FIELD OF THE INVENTION

The invention relates to a spine binder for securing a stack of sheets of paper or the like, which allows the easy insertion and removal of the sheets and also allows the inserted sheets to be turned over through nearly 360°. More particularly, the invention relates to a spine binder comprising a dorsal part and one or more pairs of opposing finger elements extending from the dorsal part and forming finger loops.

BACKGROUND OF THE INVENTION

Injection molded ring binders provide a method of removably binding paper. One such binder is provided in EP A 0 704 322 which discloses a one-piece binder made of plastic using an injection molding process. To insert paper into the binder, the loops are first spread open using a binding machine. The spring force of the individual fingers allows the loops to close and hold the paper fast.

The disadvantage of this type of spine binder in private or semiprofessional use is that a binding machine must be used in order to insert sheets of paper for the first time or any time thereafter, making assembly inconvenient. Further, such a spine binder also has the disadvantage that a stack of sheets correspondingly bound cannot be turned over completely through 360°, since the dorsal part of the binder substantially prevents such a turning over of the sheets.

OBJECTS OF THE INVENTION

It is a primary object of the invention to provide a spine binder which allows the easy insertion and removal of sheets and does not require the use of a binding machine for sheet insertion. A further object is to provide a spine binder that allows inserted sheets to be turned over through nearly 360°.

BRIEF SUMMARY OF THE INVENTION

In accomplishing these and other objects of the invention, a spine binder is provided which includes an elongated dorsal part along which pairs of individual finger elements are arranged opposite one another in two sections. The dorsal part forms a hinge whereby the free front ends of the pairs of fingers may be moved toward or away from one another. At least one of the finger elements has on its end away from the dorsal part (that is, its free front end), a first fastening element. The opposite finger element of the pair has a substantially complementary second fastening element on its free front end, which may be engaged into the first fastening element to form a closed binding finger with a releasable connection.

In this way, the user may position prepunched leaves on a series of the finger elements, and then exert pressure on the finger elements to bring them toward one another. It will be appreciated as the finger elements move toward one another, the dorsal part hinges and the finger elements close to form a closed finger element. The spine binder is latched in a closed position as the first fastening element engages the corresponding second fastening element in a positive locking.

In a preferred embodiment the dorsal part consists of essentially rectangular elements which are held in connection with one another over a thin connecting band, which forms a living hinge. Preferably, the finger elements are shaped as semicircles with the first and second fastening elements at the respective free front ends. The preferred fastening element is a push button connection, wherein a push button along the first free end engages an opening in the mating free front end.

Further advantageous embodiments are characterized in the subclaims.

A spine binder according to the invention is now explained in detail with the aid of preferred examples of execution, with the aid of the attached drawings.

DESCRIPTION OF THE PREFERRED EMBODIMENTS

Figures 1, 2, 3, 4:
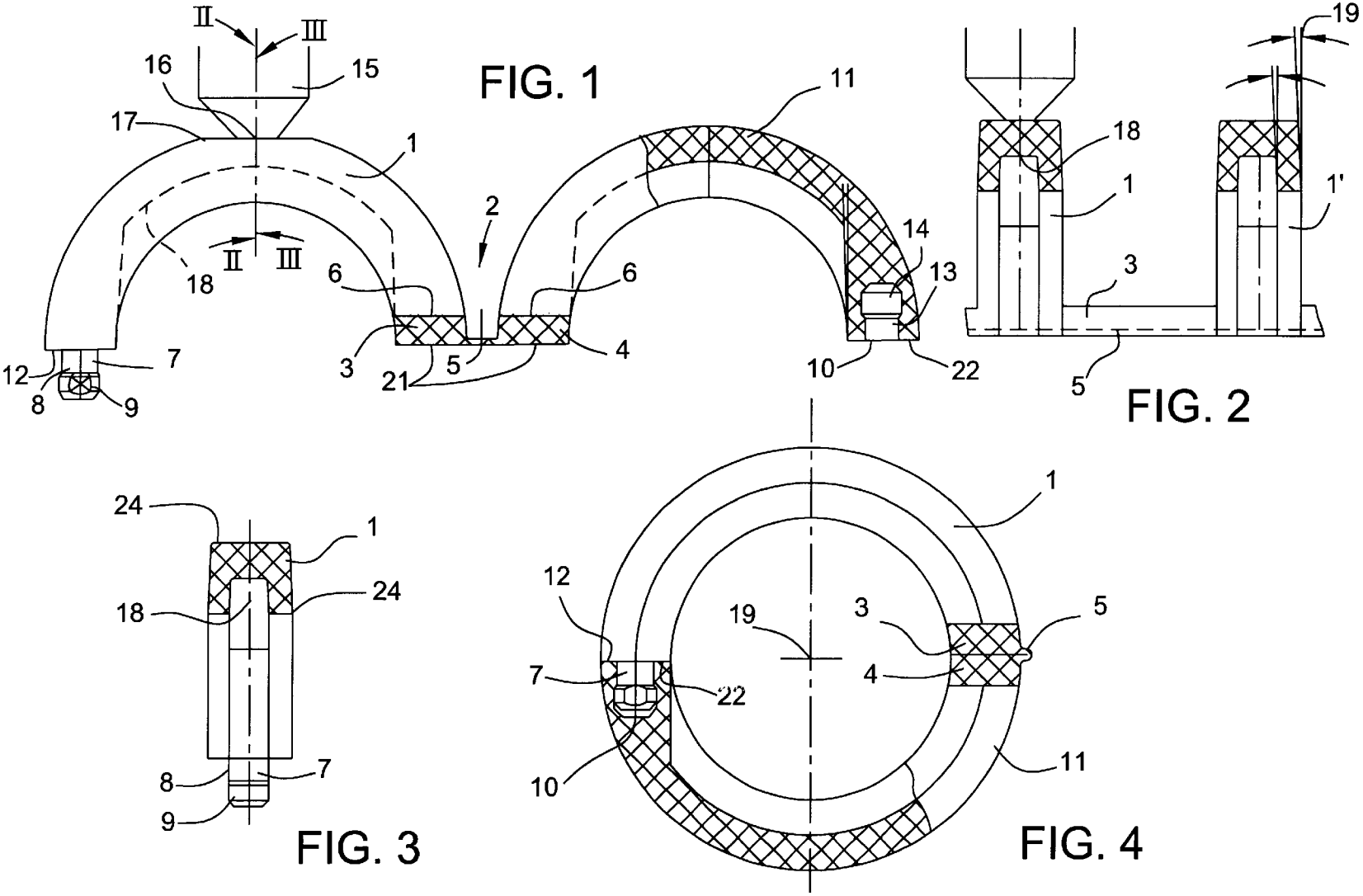
FIG. 1 is a sectional view of a side view of a spine binder according to a first embodiment of the present invention in a completely opened-up position and partially broken away along a finger element.
FIG. 2 is a longitudinal sectional view through two adjacent fingers along the line II—II according to FIG. 1.
FIG. 3 is a longitudinal sectional view through an individual finger along the line III—III according to FIG. 1.
FIG. 4 is partially sectioned view of a closed binding finger according to FIG. 1.

Turning now to the drawings, FIG. 1 shows a partially sectioned side view of a binding finger in the completely open position. The binding finger consists of two binding finger elements 1 and 11, which are joined with one another by a hinge 2 or dorsal part. The hinge 2 comprises two rectangles 3 and 4 (see also FIGS. 5 and 6), respectively, extending in longitudinal direction. These hinge rectangles 3, 4 are joined together along a connection 5, which is preferably made as thin as possible over the entire length of the spine binder. Thus, the rectangles 3 and 4 and connection 5 form the dorsal part. The individual finger pairs 1 and 11 are mounted on rear surfaces 6 of the dorsal part, opposite and turned away from the base surface 21. As the dorsal part hinges along the thin connecting part 5, the finger elements 1 and 11 are advanced toward one another. When front end surfaces 12 and 22 of the finger elements 1, 11 come into contact with one another, the closed circle of a finger represented in FIG. 4 is formed.

In the embodiment illustrated in FIGS. 1–4, the end surface 12 of the one finger element 1 is provided with a push button 7 which includes a round shaft 8 and a thickened head 9. The round shaft 8 can, of course, also be made quadrangular or otherwise. Similarly, while the round button 9 is illustrated essentially in the form of a cylinder flattened on oppositely lying sides, the button 9 can be modified so long as the determinative outside diameter of the head 9 is greater than the shaft thickness 8.

The diameter of the head 9, however, must be less than the width of the finger element 1 or 11. As the finger elements are brought together, the push button 7 enters an opening or recess 10 on the free front end, or the hinge-remote end 22 of the opposing finger element 11. The recess 10 includes an opening 13 which is complementary to the shaft 8 and receives the head part 9 of the push button 7. In the illustrated embodiment, the opening 13 is cylindrical.

Advantageously, the spine binder may be injection molded. As shown in FIG. 1, the head 15 of the injection-molding machine (not shown) is preferably disposed along an opening 16 on a flattened section 17 of the finger element 1. The finger elements 1 and 11 may each be provided with a groove or recess. The reference number 18 in FIGS. 1–3 designates the inner surface of a recess thus provided in the otherwise solid material.

In other forms of execution of the invention it is possible, of course, to produce the spine binder not by injection molding, but by stamping it, for example, out of plastic material. Further, the spine binder can also be extruded. The spine binder can alternately be made of metal, for example, and in particular, sheet metal. In such alternate embodiments, the finger 1 need not have the flattened section 17. Similarly, the inner recess 18 can be omitted, or may be formed by bent-around or stamped-around side parts of the spine binder.

FIG. 2 shows a sectioned view of two adjoining fingers along the line characterized by II—II in the arrow direction shown in FIG. 1. Like features are designated with the same reference numbers in all the drawings. It will be appreciated by those skilled in the art that the dorsal part 3 produces the one-piece connection between two adjacent fingers 1 and 1'. It will likewise be appreciated that the hinge 5 is a relatively thin section. As shown in FIG. 2, the finger elements 1 and 11 are preferably "U" shaped in cross-section, being hollowed out in their middle zone by the recess 18 as explained above.

In order to enable the user to easily turn the inserted sheets about the middle part of the finger elements, the side surfaces of the finger elements 1, 1' or 11 have a small taper, as shown in the illustrated embodiment. This taper, for example, may have an angle 19 on the order of 2°.

FIG. 3 is taken along the same line as FIG. 2 in FIG. 1. The section through a finger in the opposite direction, that is along line III—III.

It may be noted that in this embodiment, the head part 9 of push button 7 does not project beyond the shaft 8 (best seen in the side view of FIG. 3). It may likewise be noted that the width of the push button is chosen to correspond to the width of the recess 18.

FIG. 4 shows a binding finger of FIG. 1 in the closed position. It will be appreciated that the thin hinge element 5 only slightly increases the overall dimension of the spine binder. It will likewise be appreciated that the very thin rectangular elements 3 and 4 which form the dorsal part can have a very thin cross-section. In this way, the leaves inserted into the finger elements 1 and 11 can be turned almost through 360° about the longitudinal axis 19 of the spine binder.

According to an important feature of the invention, the surfaces 12 and 22 of the spine binder are flush with one another, as shown in FIG. 4. Thus, in this embodiment of the invention, the fingers 1, 11 form an inner circle and an outer circle.

Figure 5:
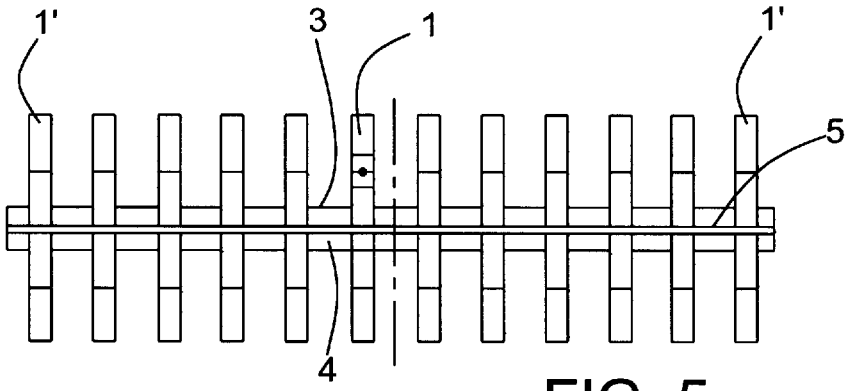
FIG. 5 is a plan view of a spine binder with binding fingers according to FIG. 1.

FIG. 5 shows a plan view of a spine binder wherein the hinge is in a fully opened position. The spine binder includes a series of binding fingers arranged adjacently along the dorsal part 3–5. The plastic material of the spine binder is preferably injected at a point on finger element 1.

Figure 6:
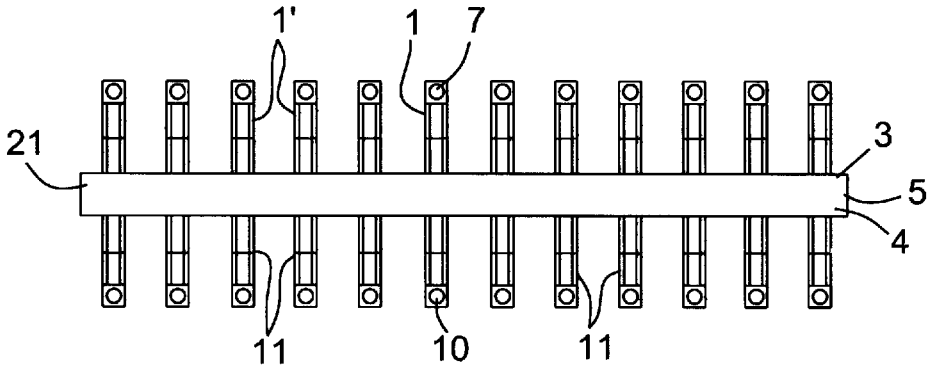
FIG. 6 is an underview of the spine binder according to FIG. 5.

FIG. 6 shows an underview of the spine binder according to FIG. 5. It will be appreciated that the push button 7 and the oppositely lying recess 10 cannot be represented in detail in view of the reduced size of the drawing. Since the thin hinge 5 is preferably planar with the elongated rectangles 3 and 4 of the dorsal part, the totally planar surface 21 is visible in this view. In use, the operator places the spine binder in the position shown in FIG. 6 for the initial insertion of leaves. The user lays leaves onto the finger 1 or 11 and then closes the fingers 1 and 11 in order to provide the closed fingers illustrated in FIG. 4.

Preferably, the spine binder is of plastic and is produced by injection molding. The height of the rectangles 3 and 4, which is exaggerated in the illustrated embodiment, may run on the order of 0.5 mm, for example, so that the dorsal part has a total height of 1 mm. It is, of course, also possible to form the dorsal part elements 3 and 4 in other than rectangular form.

The finger elements 1 and 11 may likewise have alternate structures. These, in particular, do not have to cover the same circular arc. Thus, one of the finger elements 1 may cover a larger circular arc than 180°, for example, 270° or even 360°, so long as the complementary circular arc 11 is correspondingly shorter. Furthermore, instead of the finger elements 1 and 11 having a circular shape, the finger elements may have, for example, a rectangular or square shape, even though the inserted pages could not be as readily turned. In particular, in order to facilitate labeling, the finger elements can be shaped so that a closed finger element results in a semicircle with a chord base. The fingers would then have a "D" in cross section. Finally, it is also possible to round off the binding fingers, in order to permit easier sliding of the inserted sheets. Preferably all four outer edges of the finger elements 1 and 11 would be rounded, i.e., in particular, all the corners which are designated with the reference number 24 in FIG. 3

To facilitate removal or addition of perforated sheets without a machine, the push button connection of the spine binder illustrated in FIGS. 1–6 may be opened and be closed a number of times. In the illustrated embodiment, the push buttons are provided in each of the appertaining finger pairs. This is not absolutely necessary, however, for example, even if only every other finger pair includes push button closures, the closed hinge 5 along with the dorsal part elements 3 and 4 will provide adequate closing force to secure the intervening finger elements together, even though they have no push button connection. It will thus be appreciated that even if some of the individual push buttons inadvertently break-out or wear-out, the inserted sheets will still be securely bound together.

In a simplified embodiment, the push buttons 7, 8, 9 could be constructed without the thickened head 9. If each push button includes only a shaft 8, then a tenable friction connection can be created if the diameter of the opening 10 is somewhat smaller than the shaft thickness.

Figure 7:
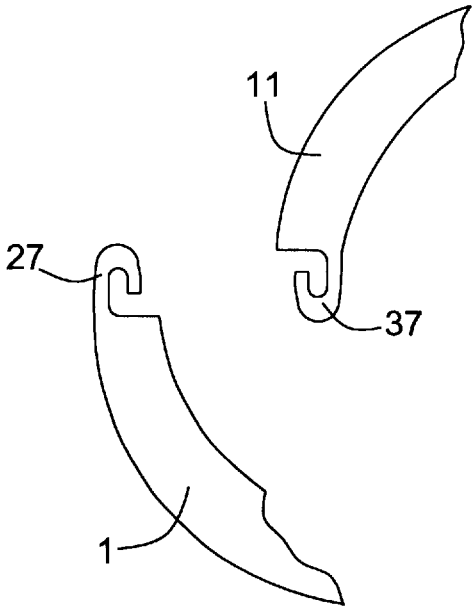
FIG. 7 is a fragmentary side view of a pair of mating individual finger elements of a spine binder according to a second embodiment of the present invention.

FIG. 7 shows a side view of a finger of a spine binder according to a second embodiment of the invention. Besides the push button connection it is also possible to form a releasable connection with hook elements. In FIG. 7, each binding finger element 1 or 11 includes a hook 27 or 37, which complement one another to form a closure. The hooks 27, 37 fit snugly on one another, so that - in the mathematical sense - a constant transition is provided from the binding finger element 1 to the binding finger element 11. In the simple embodiment illustrated, the hooks 27, 37 occupy the entire width of the binding finger elements. In other embodiments, a web-and-groove combination can be provided in the area of the hooks 27, 37, to minimize any lateral separation of the hooks when shearing forces are applied.

Figure 8:
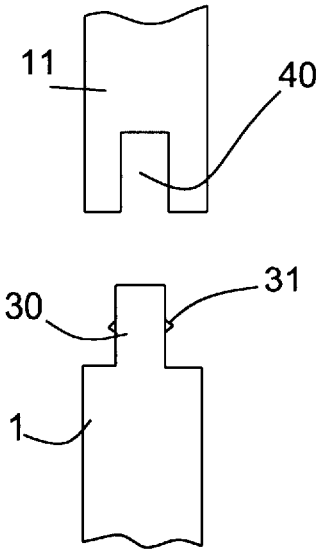
FIG. 8 is a fragmentary front view of a pair of mating individual finger elements of a spine binder according to a third embodiment of the present invention.

FIG. 8 shows a front view of a finger of a spine binder according to a third embodiment of the invention. In this embodiment, the fastening elements 30 and 40 consist of a pin 30 projecting from the end of the binding finger element 1. The pin 30 can have, for example, small raised projections 31 on both sides. The end of the binding finger element 11 is formed with a complementary groove 40, into which the pin 30 may be inserted. The groove 40 runs through the entire end of each finger element 11, and may be fit over recesses (not represented in the drawing) into cams or projections 31.

Figures 9, 10, 11:
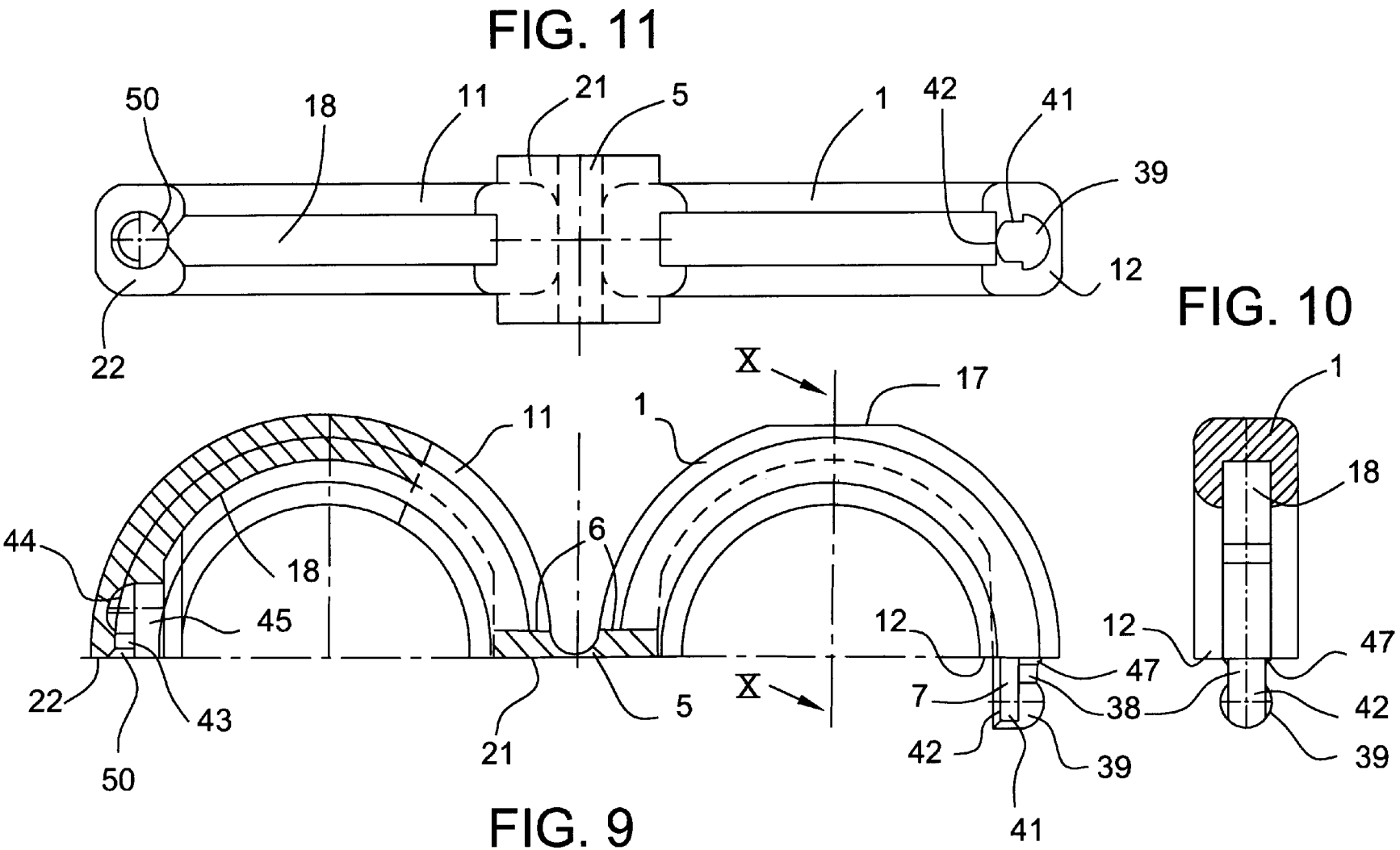
FIG. 9 is a cross section through an individual finger of a completely opened-up spine binder according to a fourth embodiment of the present invention.
FIG. 10 is a longitudinal section through a finger along the line X—X according to FIG. 9.
FIG. 11 is an underview of an individual finger of the spine binder according to FIG. 9.

FIG. 9 shows a cross section through a finger of a completely opened-up spine binder according to a fourth embodiment of the invention. Like features of the spine binder formed from these fingers have like reference numbers with respect to the other figures. On the one end surface 12 of the one finger element 1 there is provided a push button 7 which includes a partially round and partially flattened shaft 38 along with a partially thickened head 39. The dimension of the outside diameter of the head 39 is at least slightly greater than the shaft thickness 38. A lateral flattened surface is provided on the inward-facing side of the finger 1, which transitions into a rounded front surface 42 (best seen in FIG. 11).

When the connection 5 is hinged to fold the finger elements together, the push button 7 enters an opening 50 on the hinge-remote end 22 of the finger element 11. The recess 50 includes an opening 43, which is complementary to the shaft 38. In the illustrated embodiment, the opening 43 has a generally cylindrical mouth which widens into an enlarged recess 44 that receives the head part 39 of the push button 7. The inward-facing section 45 of the recess 44 has a structure which is complementary to the flattened section of the push button 7.

As with the embodiment illustrated in FIGS. 1–4, the embodiment illustrated in FIG. 9 may be readily injection molded. The finger element 1 includes a flattened section 17 at which the injection molding head may inject material. If the spine binder is to be used for an A4 paper format, for example, thirty-four fingers may be provided. In this arrangement, the sixth or seventh finger (counted from the border) as well as a middle finger are preferably each provided with an injection molding inlet. Reference number 18 designates the inner surface of a recess which is provided in the otherwise solid material of the finger elements 1 and 11 and which forms in each case a groove. The hinge 5 is rounded in a circular arc on its side lying opposite the surface 21.

FIG. 10 shows a longitudinal section through a finger along the line X—X in FIG. 9. FIG. 10 clearly illustrates the foot sections 47 on the underside 12 of finger element 1, which are disposed underneath the thickened head element 39.

FIG. 11 shows an underview of a finger of the spine binder according to FIG. 9. FIG. 11 clearly illustrates the circular opening 50, which has a semicircular tapered section for the shaft zone. The underview of the button 7 shows the inner section, flattened and having no foot sections 47. This structure facilitates an easy releasing of the spine binder from the injection molding mold.

What is claimed is:

1. A spine binder for securing a stack of sheets, said spine binder comprising an elongated dorsal part comprising a first elongated, generally rectangular hinge section disposed in a first plane and a second elongated, generally rectangular hinge section disposed in a second plane, and a hinge, said hinge connecting said hinge sections, and said hinge having a smaller thickness in comparison with said hinge sections, a plurality of pairs of opposing finger elements, said finger elements having a free front end and a rear end, said rear ends of the opposing finger elements being integrally connected to said hinge sections, respectively, said front ends of a pair of finger elements being adapted to contact to form a finger loop, said hinge and said elongated hinge sections being disposed between said pair of opposing finger elements whereby the free front ends of the pair of opposing finger elements may be toward and away from each other to move the spine binder between an open position wherein the finger loops are away from each other and a closed position wherein the finger loops are disposed toward each other, said elongated hinge sections and said first and second planes being disposed at an angle to one another when the spine binder is in the open position and substantially parallel one another when the spine binder is in the closed position, said stack of sheets being rotatable substantially 360° along said finger loops when said finger loops are disposed in said closed position, a first fastening element disposed at the free front end of the at least one finger element, a complementary second fastening element at the free front end of the opposing finger element adapted for engagement with said first fastening element whereby the first and second fastening elements secure the finger loop together in the closed position, and said elongated hinge sections, said hinge, said plurality of opposing finger elements and said fastening elements being unitarily formed.

2. The spine binder according to claim 1, wherein contact of the free front ends of the opposing finger elements and engagement of the first and second fastener means forms a torus.

3. The spine binder according to claim 1, wherein each individual finger element is substantially in the shape of a semicircle.

4. The spine binder according to claim 1, wherein the finger elements have exterior surfaces and the free front ends of opposing finger elements join together such that the exterior surfaces of the finger elements are flush with one another.

5. The spine binder according to claim 1, wherein the finger elements of at least three pairs of opposing finger elements comprise respective fastener elements.

6. The spine binder according to claim 5, wherein the first fastening element is a pushbutton with a shaft and a thickened head, and the second fastening element has an opening with a channel and a cavity which can accommodate the thickened head.

7. The spine binder according to claim 1, wherein said finger elements have an inner surface, said inner surface comprising a U-shaped recess.

8. The spine binder according to claim 1, wherein said finger elements have a substantially rounded cross section.

9. The spine binder according to claim 1, wherein the finger elements have side surfaces, the side surfaces being tapered along a length between the free front end and the dorsal part.

10. The spine binder according to claim 1, wherein the first fastening element is a pushbutton having a shaft and a thickened head, and the second fastening element comprises an opening having a channel and a cavity adapted to receive said shaft and said thickened head.

11. The spine binder according to claim 1, wherein the first fastening element comprises a first hook and the second fastening element comprises a second hook adapted to engage said first hook.

12. The spine binder according to claim 1, wherein the first fastening element comprises a male component having at least one protrusion extending therefrom, and the second fastening element comprises a female component adapted to receive said at least one protrusion.

13. The spine binder according to claim 1, wherein the first fastening element comprises a shaft having a substantially T-shaped cross-section and an enlarged head, and the second fastening element comprises a bore having a substantially T-shaped cross-section and a cavity adapted to receive said enlarged head.

14. The spine binder according to claim 1, wherein said finger loop is substantially "D-shaped."

15. The spine binder according to claim 1, wherein the finger elements have exterior surfaces and the free front ends of opposing finger elements join together such that the exterior surfaces of the finger elements are flush with one another.

16. The spine binder according to claim 1, wherein the finger elements of at least three opposing finger pairs have fastening elements.

17. The spine binder according to claim 1, wherein the finger element has side surfaces, the side surfaces being tapered along a length between the free front end and the dorsal part.

18. The spine binder according to claim 1, wherein the first fastening element is a pushbutton with a shaft and a thickened head, and the second fastening element has an opening with a channel and a cavity which can accommodate the thickened head.

19. A spine binder for securing a stack of sheets, said spine binder comprising an elongated dorsal part comprising a first elongated hinge section disposed in a first plane and a second elongated hinge section disposed in a second plane, and a hinge, said hinge connecting said hinge sections, and a plurality of pairs of opposing finger elements, said finger elements having a free front end and a rear end, said rear ends of the opposing finger elements being integrally connected to said hinge sections, respectively, said front ends of a pair of finger elements being adapted to contact to form a finger loop, said finger elements having an inner surface, said inner surface comprising a U-shaped recess, said hinge and said elongated hinge sections being disposed between said pair of opposing finger elements whereby the free front ends of the pair of opposing finger elements may be toward and away from each other to move the spine binder between an open position wherein the finger loops are disposed away from each other and a closed position wherein the finger loops are disposed toward each other, said elongated hinge sections and said first and second planes being disposed at an angle to one another when the spine binder is in the open position and substantially parallel one another when the spine binder is in the closed position, said stack of sheets being rotatable substantially 360° along said finger loops when said finger loops are disposed in said closed position, a first fastening element disposed at the free front end of the at least one finger element, a complementary second fastening element at the free front end of the opposing finger element adapted for engagement with said first fastening element whereby the first and second fastening element secure the finger loop together in the closed position, and said elongated hinge sections, said hinge, said plurality of opposing finger elements and said fastening elements being unitarily formed.

* * * * *